United States Patent [19]

Alley

[11] 3,959,842

[45] June 1, 1976

[54] TONGUE TOOTHBRUSH

[75] Inventor: David W. Alley, Houston, Tex.

[73] Assignees: Pravel & Wilson; David W. Alley, both of Houston, Tex. ; part interest to each

[22] Filed: Apr. 18, 1975

[21] Appl. No.: 569,369

[52] U.S. Cl. ..... 15/167 R; 15/227; 32/40 R; 128/62 A; 132/93

[51] Int. Cl.[2] ..... A46B 9/04

[58] Field of Search ..... 15/167 R, 110, 227; 32/34, 35, 40; 128/12–16, 62 A; 132/89–93

[56] References Cited

UNITED STATES PATENTS

| | | | |
|---|---|---|---|
| 472,017 | 3/1892 | Gartner | 15/227 X |
| 760,339 | 5/1904 | Marsh | 15/227 |
| 1,343,713 | 6/1920 | Fuller | 15/227 |
| 1,465,522 | 8/1923 | Lunday | 15/167 R |
| 2,167,129 | 7/1939 | Sleeper | 15/227 X |
| 2,883,691 | 4/1959 | Gruenwald | 15/227 X |
| 3,043,295 | 7/1962 | Ward | 15/110 X |
| 3,505,700 | 4/1970 | Rodriguez | 15/227 X |

*Primary Examiner*—Peter Feldman
*Attorney, Agent, or Firm*—Pravel & Wilson

[57] ABSTRACT

A tongue toothbrush adapted to be mounted with the tongue both for loosening particulate matter entrapped between the teeth and for cleansing the teeth.

17 Claims, 3 Drawing Figures

TONGUE TOOTHBRUSH

BACKGROUND OF THE INVENTION

The field of this invention is toothbrushes used for cleaning teeth.

In the realm of proper care of the teeth, it is well known that proper brushing is a significant factor in both keeping teeth healthy as well as preventing tooth decay and disease. Prior art toothbrushes include those toothbrushes such as disclosed in U.S. Pat. Nos. 2,167,129, 2,763,885, 3,583,109, 3,231,925 and 3,853,412.

However, numerous disadvantages are inherent with the prior art in that there is difficulty in reaching the remote portions of the mouth wherein teeth adjacent to such areas are susceptible to tooth decay due to the lack of proper care thereof and/or the requirements of inserting fingers or the like into the mouth for cleaning the teeth, resulting in the possibility of unhygienic conditions within the oral cavity.

SUMMARY OF THE INVENTION

The present invention provides a new and improved tongue toothbrush adapted to be resiliently mounted with the tongue for cleansing the teeth, the tongue toothbrush having a flexible hollow body member adapted to releasably engage the exterior portion of the tongue when mounted therewith and means for cleansing the teeth by appropriate movement of the tongue, the cleansing means being mounted with body member adjacent the tip of the tongue when the body member is mounted therewith the tongue.

DESCRIPTION OF THE PREFERRED EMBODIMENTS

Figures 1, 2, 3:
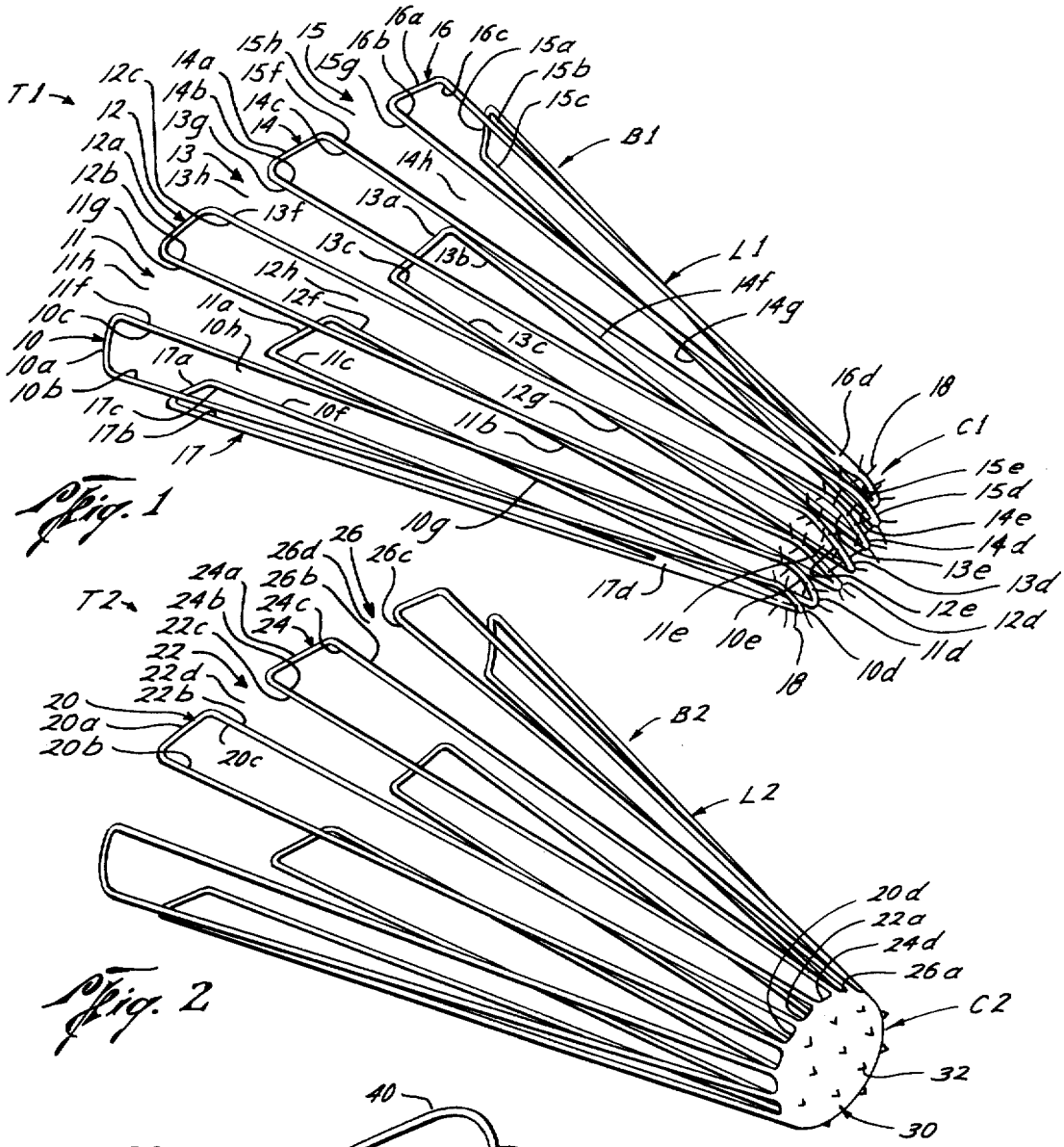
FIG. 1 is an isometric view of the first embodiment of the tongue toothbrush of the present invention.
FIG. 2 is an isometric view of the second embodiment of the tongue toothbrush of the present invention; and, FIG. 3 is an isometric view of the third embodiment of the tongue toothbrush of the present invention.

Referring the the drawings, the letter T designates the tongue toothbrush of the present invention that is adapted to be mounted with a tongue (not shown) for cleansing the teeth (not shown).

The tongue toothbrush T includes a flexible body member B having at least one loop L adapted to resiliently and releasably engage the tongue and cleansing means C formed or mounted with the loop L adjacent the tip of the tongue for cleansing the teeth by appropriate movement of the tongue. As shown in FIGS. 1, 2 and 3, the tongue tooth-brush T is depicted showing a first embodiment tongue tooth-brush T1, a second embodiment tongue toothbrush T2, and a third embodiment tongue toothbrush T3, having respectively, body members B1, B2, B3 having loops L1, L2, L3 and cleansing means C1, C2, C3, respectively.

The tongue toothbrush T of the present invention is adapted to be resiliently mounted on a tongue (not shown). As is well known, a tongue is typically of greater cross sectional area at its rear portion where it is attached within the oral cavity than the cross sectional area of the tongue adjacent its tip. As such, the tongue toothbrush T of the present invention has a configuration that is substantially the same as that of the tongue. More specifically, it is generally that of a truncated, hollow ovaloid cone having a longitudinal axis that substantially coincides with the longitudinal axis of the tongue as described more fully hereinbelow.

As shown in FIG. 1, the tongue toothbrush T1 includes a flexible body member B1 having loops L1 and cleansing means C1 for cleansing the teeth. The loops L1 include a plurality of loops disposed about the generally truncated, hollow ovaloid conical configuration of the body member B1 and include elongated loops 10, 11, 12, 13, 14, 15, and closure loops 16, 17 as is discussed in full detail hereinbelow.

Each of the elongated loops L1 are formed generally in an elongated trapezoidal configuration being folded in half about its mid portion, such as a first loop 10 having closed end base 10*a*, elongated converging sides 10*b*, 10*c*, mid portions 10*d*, 10*e*, elongated diverging sides 10*f*, 10*g*, and an open end portion 10*h* where an appropriate end closure would be formed. In opposing fashion, a second loop 11 is formed in an inverted elongated trapezoidal configuration and includes a closed end base 11*a* having converging elongated sides 11*b*, 11*c*, mid portions 11*d*, 11*e*, elongated diverging sides 11*f*, 11*g*, and an open end portion 11*h*where an appropriate end closure would be formed. Loops 12, 14, 16 are substantially identical to loop 10 having closed end bases 12*a*, 14*a*, 16*a*, respectively, elongated sides 12*b*, 14*b*, 16*b* and 12*c*, 14*c*, 16*c*, mid portions 12*d*, 14*d*, 16*d* and 12*e*, 14*e*, 16*e*, elongated sides 12*f*, 14*f*, 16*f* and 12*g*, 14*g*, 16*g*, and open end portions 12*h*, 14*h*, 16*h*. Loops 13, 15, much as loop 11, have closed end bases 13*a*, 15*a*, elongated sides 13*b*, 15*b* and 13*c*, 15*c*, mid portions 13*d*, 15*d* and 13*e*, 15*e*, elongated sides 13*f*, 15*f* and 13*g*, 15*g* and open end portions 13*n*, 15*h*, respectively. Closure loops 16, 17 are formed in a generally triangular configuration each having its respective end bases 16*a*, 17*a*, and intersecting elongated sides 16*b*, 17*b* and 16*c*, 17*c* which intersect at points 16*d*, 17*d*, respectively.

The loops 10, 11, 12, 13, 14, 15 are formed adjacent to one another such that there is a common side portion therebetween. Thus, loops 10 and 11 have in part side portions 10*c*, 11*f*, respectively, common to each other. In similar fashion, loop 11 and loop 12 have in part a common side portion made up of side portions 11*g*, 12*b*, respectively, as do loops 12, 13 having a common side portion formed of side portions 12*c*, 13*f*, respectively. Thus, each loop L1 has two sides that are common to the loops L1 formed on each side thereof, as loop 14 has in part side portions 14*c*, 15*f* in common with loop 15 and 14*b*, 13*g*, in common with loop 13.

As noted hereinabove, loops 10, 12, 14 are substantially identical to each other with loops 11, 13, 15 also being substantially identical to each other and being the mirror image of loops 10, 12, 14. As such, the loops 10–15 form one continuous loop or interconnecting strand which commences and terminates at the intersecting points 16*d*, 17*d* of the closure loops 16, 17, respectively.

The closed end base portions 10*a*, 12*a*, 14*a*, 16*a*, 15*a*, 13*a*, 11*a*, 17*a*, respectively, of the loops L1 form an ovaloid segmented portion S1 adjacent one end of the body member B1 of the tongue toothbrush T1 of the present invention. It is intended that the loops 10, 12, 14, are formed substantially identical to one another as are the loops 11, 13, 15 and the like disposed therebetween in similar fashion thereabout the generally truncated, hollow ovaloid conical configuration of the body member B1 of the tongue toothbrush T1.

Affixed to or formed therewith the mid portions 10*d*–15*d*, 10*e*–15*e*, respectively, of the loops L1 is a cleansing means C1 for cleansing the teeth, the cleansing means C1 including bristles 18 formed with the mid portions of the loops L1. Preferably, the bristles 18 extend radially outwardly therefrom the mid portions 10*d*–15*d*, 10*e*–15*e*, respectively. Alternatively, the bristles may extend outwardly along the longitudinal axis of the body member B1 or in any other random desirable direction for effectuating proper cleansing of the teeth when the tongue toothbrush is appropriately mounted with the tongue.

In the use or operation of the tongue toothbrush T1, the flexible body member B1 is placed over the tongue (not shown) by first inserting the tip of the tongue through the first segmented end portion S1, sliding the body member B1 of the tongue toothbrush T1 along the longitudinal axis of the tongue until the tip of the tongue is adjacent the cleansing means C1. The open end portions 10*h*, 11*h*, 12*h*, 13*h*, 14*h*, 15*h* of the loops 10–15 allow for flexible expansive and contractive movement therebetween adjacent loops L1 such that the bases and side portions of the loops L1 resiliently engage the exterior portion of the tongue for mounting the flexible body member B1 therewith.

Preferably, all elements of the tongue toothbrush T1 are formed of resilient flexible nylon, rubber, polyvinylchloride, or any other suitable material capable of flexible bending yet retaining structural integrity.

With the body member B1 being resiliently mounted with the tongue, the tongue may be freely moved thereabout the mouth with the tongue toothbrush T1 therewith the tongue for loosening entrapped particulate matter with the bristles 18 mounted thereon the body member B1 and further scraping and cleansing the teeth with the same. Due to the resilient flexible nature of the tongue toothbrush T1, the tongue toothbrush T1 may be used for cleansing the teeth in remote areas of the mouth at any position where the tongue may be moved therein, most notably in the remote areas adjacent the wisdom teeth.

A second embodiment of the tongue toothbrush T is shown in FIG. 2 and includes tongue toothbrush T2 having flexible body member B2 formed of loops L2 and cleansing means C2 for cleansing the teeth.

The body member B2 of the tongue toothbrush T2 is formed having loops L2 similar to loops L1 shown in FIG. 1. The loops L2 include in part loops 20, 22, 24, 26. Loop 20 is generally of an elongated trapezoidal configuration having a closed end base 20*a*, elongated converging sides 20*b*, 20*c* and a closed end top 20*d* in a substantially opposed parallel relationship to the closed end base 20*a*. Loop 22 is of a generally inverted trapezoidal configuration having a closed end base 22*a*, elongated diverging sides 22*b*, 22*c* and an open end portion 22*d* adjacent the end opposing the base portion 22*a*. Loop 24 is formed similar to loop 20 having a closed end base 24*a*, converging elongated sides 24*b*, 24*c* and a closed end top portion 24*d*. Loop 26 is formed in similar fashion to loop 22, having a closed end base 26*a*, diverging elongated sides 26*b*, 26*c*, and an open end 26*d* opposing the base 26*a*.

In similar fashion to the tongue toothbrush T1, the body member B2 is formed having the loops 20, 22, 24, 26 and the like formed adjacent to one another such that each loop L2 has common side portions with those loops immediately adjacent thereto. For example, loop 22 has side portion 22*b*which is common to side portion 20*c*of loop 20 and side portion 22*c* which is in common with side portion 24*b* of loop 24. In like fashion, loop 24 has side portion 24*c* in common with side portion 26*b* of loop 26 and so forth thereabout the loops L2 of the body member B2 of the tongue toothbrush T2.

The base portions 20*a*, 24*a*, of alternating loops 20, 24 form a first segmented end portion S1′ at one end of the body member B2. At the opposing end, however, alternating top portions 20*d*, 24*d* and adjacent alternating base portions 22*a*, 26*a* are formed theretogether with the cleansing means C2. The cleansing means C2 includes a resilient head 30 formed with the flexible body member B2. The resilient head 30 is preferably of a substantially hemispherical configuration and has a plurality of protrusions 32 formed thereon the outer surface thereof to aid in loosening entrapped particles from therebetween the teeth and cleansing of the teeth. Preferably, the head 30 as well as the entire tongue toothbrush T2 is made of a suitable pliable, resilient, hygienic material such as nylon, rubber, polyvinylchloride, or the like, capable of being used within the mouth for cleansing the teeth without damaging either the enamel of the teeth or the gums adjacent the teeth.

Much as with tongue toothbrush T1, the body member B2 resiliently engages the external portion of the tongue with the tongue being inserted first therethrough the segmented opening S1′ thereinto the substantially hollow, truncated, ovaloid conical portion of the body member B2 such that the tip of the tongue is adjacent to the resilient head 30. The cleansing operation with tongue toothbrush T2 is similar to that as described hereinabove in conjunction with tongue toothbrush T1. By using the tongue having the tongue toothbrush T2 mounted thereon to manipulate the same thereabout the mouth, the head 30 having protrusions 32 thereon is appropriately positioned adjacent the teeth for loosening particles entrapped therebetween and for cleansing the same by reciprocal or rotational movement of the tongue.

A third embodiment of the tongue toothbrush T of the present invention is shown in FIG. 3 as tongue tooth-brush T3. The tongue toothbrush T3 includes a flexible body member B3 formed of loops L3 and cleansing means C3 for cleansing the teeth. The loops L3 of the body member B3 preferably extend circumferentially about the exterior portion of the tongue and are adapted to be receivably mounted with the tongue. The loops L3 include an ovaloid loop 40, spiralling loops 42, 44, 46 and a plurality of substantially ovaloid adjacent spiraling end portion loops 52. The loops L3 are formed adjacent one another and are adapted to extend therebetween the areas adjacent the rear portion and the tip of the tongue when appropriately positioned thereon the tongue. The loop 40 adapted to be mounted adjacent the rear portion of the tongue forms a substantially ovaloid annular first ring for engaging the rear portion of the tongue. The end portion loops 52 are adapted to be mounted adjacent the tip of the tongue and form a substantially ovaloid end portion for engaging the portion of the tongue adjacent the tip thereof. A plurality of continuous loops L3 are formed therebetween the first annular ring 40 and the end portion 52 forming a continuous spiral adapted to extend circumferentially about the exterior portion of the tongue therebetween the areas adjacent the rear portion and the tip of the tongue when appropriately mounted thereon. Preferably, the spiral is formed of nylon, however, any other suitable material may be used. Thus, the body member B3 includes loops 42, 44, 46 forming a continuous spiral extending therebetween the first annular ring 40 and the end portion 52.

Cleansing means C3 is mounted with the flexible body member B3 and includes the end portion 52 having bristles 54 preferably formed therewith and extending outwardly therefrom the outer surface thereof. Thus, the spiral loops L3 of the flexible body member B3 of the tongue toothbrush T3 resiliently engage the tongue when the tongue is positioned such that the ring 40 is adjacent the rear portion thereof and the end portion 52 is adjacent the tip thereof. As with the above-identified tongue toothbrushes T1, T2, the tongue toothbrush T3 is adapted to be moved freely about the interior portion of the oral cavity for appropriate cleansing of the teeth.

The resilient nature of the flexible body members B1, B2, B3 and their respective loops L1, L2, L3 being of a smaller annular surface area than the tongue allow the tongue toothbrushes T1, T2, T3 to be quickly and efficiently resiliently mounted with the tongue for proper brushing of the teeth. Furthermore, the tongue toothbrush of the present invention promotes increased oral hygiene by permitting increased ease of access to remote portions of the mouth where difficulty of brushing is encountered. Furthermore, the tongue toothbrush T of the present invention may be easily manufactured according to well-known plastic extrusion processes and the like resulting in an inexpensive, disposable (if desired) toothbrush.

It is intended that the tongue toothbrush T of the present invention not be limited to the embodiments thereof as shown in FIGS. 1-3. The tongue toothbrushes T1, T2, T3 are embodiments for illustrative purposes. For example, the spiralling loops L3 of tongue toothbrush T3 could easily be adapted to be used with the bristles 18 of the tongue toothbrush T1, resulting in a fourth embodiment. Additionally, the loops L2 of tongue toothbrush T2 could be adapted to be used with the bristles 18 of tongue toothbrush T1, resulting in a fifth embodiment. Further, the flexible body members B1, B2, B3 may be of any other suitable design, such as being slotted, slitted, or of a suitable solid exterior surface area, by way of sample, but not limited thereto. Thus, multiple embodiments of tongue toothbrushes T are intended to be included within the scope of this disclosure.

The foregoing disclosure and description of the invention are illustrative and explanatory thereof, and various changes in the size, shape, and materials as well as in the details of the illustrated construction may be made without departing from the spirit of the invention.

I claim:

1. A tongue toothbrush adapted to be mounted with a tongue for cleansing teeth, comprising:

a hollow flexible body member adapted to receive the tongue and adapted to releasably engage the exterior portion of the tongue when mounted therewith;

said body member including a plurality of adjacent, spaced, yieldable loops adapted to surround the tongue; and, means for cleansing the teeth by appropriate movement of the tongue, said cleansing means mounted with said body member adjacent the tip of the tongue when said body member is mounted with the tongue.

2. The tongue toothbrush of claim 1, wherein:

said loops include a plurality of adjacent first and second longitudinally extending loops adapted to be folded about a mid portion thereof located adjacent the tip of the tongue, said first loops each having a first end which is closed adjacent the rear portion of the tongue, and being folded about said mid portion thereof adjacent the tip of the tongue, and a second end being open adjacent the rear portion of the tongue when said body member is mounted with the tongue.

3. The tongue toothbrush of claim 2, wherein:

said second loops each having a first end which is closed adjacent the rear portion of the tongue being folded about said mid portion thereof adjacent the tip of the tongue and a second end being open formed adjacent the rear portion of the tongue, said first closed end of said second loops being formed alternately adjacent to each of said second open ends of said first loops and said second open end of said second loop being formed alternately adjacent each of said first closed ends of said first loops forming a first segmented end portion of said body member adapted to be mounted adjacent the rear portion of the tongue.

4. The tongue toothbrush of claim 3, wherein said cleansing means includes:

bristle means mounted with said mid portions of said first and said second loops for cleansing the teeth by appropriate movement of the tongue when mounted therewith.

5. The tongue toothbrush of claim 4, wherein said bristle means includes:

a plurality of bristles resiliently mounted with said mid portions of said first and said second loops and extending radially therefrom.

6. The tongue toothbrush of claim 1, wherein:

said loops includes a plurality of adjacent first and second loops, said first loops each having a first end being closed adjacent the tip of the tongue and a second end being open formed adjacent the rear portion of the tongue when said body member is mounted therewith the tongue; and said second loops each having a first end being closed adjacent the rear portion of the tongue and a second end being closed adjacent the tip of the tongue, said second closed ends of said second loops adjacent the tip of the tongue being formed theretogether with said first closed ends of said first loops.

7. The tongue toothbrush of claim 6, wherein said cleansing means includes:

a resilient head formed with said loops adjacent the tip of the tongue for cleansing the teeth by appropriate movement of the tongue.

8. The tongue toothbrush of claim 7, wherein said head further includes:

a plurality of protrusions formed with said head to aid in loosening particulate matter entrapped between the teeth.

9. The tongue toothbrush of claim 1, wherein:

said body member includes at least one loop that extends circumferentially about the exterior portion of the tongue and adapted to be receivably mounted with the tongue.

10. The tongue toothbrush of claim 9, wherein:

said loop includes a plurality of continuous loops formed adjacent one another extending circumferentially about the exterior portion of the tongue therebetween the areas adjacent the rear portion and the tip of the tongue when said body member is mounted therewith the tongue.

11. The tongue toothbrush of claim 10, wherein:

said loops include a first annular ring adapted to be mounted adjacent the rear portion of the tongue for engaging the rear portion of the tongue.

12. The tongue toothbrush of claim 10, wherein:

said loops include an end portion formed of adjacent spiraling loops adapted to be mounted adjacent the tip of the tongue for engaging the portion of the tongue adjacent the tip thereof.

13. The tongue toothbrush of claim 12, wherein said cleansing means includes:

bristle means mounted with said adjacent spiraling loops adjacent the tip of the tongue for cleansing the teeth by appropriate movement of the tongue.

14. The tongue toothbrush of claim 12, wherein said cleansing means includes:

a resilient head mounted with said adjacent spiraling loops for cleansing the teeth by appropriate movement of the tongue.

15. The tongue toothbrush of claim 14, wherein said head further includes:

a plurality of protrusions formed with said head to aid in loosening particulate matter entrapped between the teeth.

16. The tongue toothbrush of claim 10, wherein:

said plurality of continuous loops form a continuous spiral extending circumferentially about the exterior portion of the tongue therebetween areas adjacent the rear portion and the tip of the tongue when said body member is mounted with the tongue.

17. The tongue toothbrush of claim 1, wherein:

said body member has a configuration being substantially a hollow truncated ovaloid cone.

* * * * *